United States Patent [19]

Heilig et al.

[11] 4,000,225

[45] Dec. 28, 1976

[54] SONIC FLOW VARIABLE AREA VENTURI CARBURETOR

[75] Inventors: Louis F. Heilig, Newport Beach; Warren F. Kaufman, Santa Ana, both of Calif.

[73] Assignee: Ford Motor Company, Dearborn, Mich.

[22] Filed: Jan. 15, 1976

[21] Appl. No.: 649,378

[52] U.S. Cl. ..... 261/39 B; 261/39 D; 261/46; 261/50 R; 261/DIG. 56; 261/DIG. 78

[51] Int. Cl.[2] ..... F02M 1/10; F02M 9/14

[58] Field of Search ... 261/50 R, DIG. 78, DIG. 56, 261/39 B, 39 D, 46

[56] References Cited

UNITED STATES PATENTS

| | | | |
|---|---|---|---|
| 1,389,016 | 8/1921 | Stewart | 261/50 R |
| 1,932,764 | 10/1933 | Benjamin et al. | 261/50 R |
| 2,223,381 | 12/1940 | Mock | 261/46 |
| 2,789,801 | 4/1957 | Durbin | 261/46 |
| 3,246,886 | 4/1966 | Goodyear et al. | 261/39 D |
| 3,281,132 | 10/1966 | Barnes | 261/50 A |
| 3,365,179 | 1/1968 | La Force | 261/46 |
| 3,529,809 | 9/1970 | Von Seld | 261/50 R |
| 3,778,038 | 12/1973 | Eversole et al. | 261/DIG. 78 |
| 3,943,205 | 3/1976 | Oliver | 261/DIG. 67 |
| 3,953,548 | 4/1976 | Knapp et al. | 261/DIG. 78 |

*Primary Examiner*—Tim R. Miles
*Attorney, Agent, or Firm*—Robert E. McCollum; Keith L. Zerschling

[57] ABSTRACT

A sonic flow-type carburetor having a variable area venturi defined by a conical air nozzle receiving axially within a movable matching conically-shaped plug to define a constricted annular variable area or zone between through which air flows at sonic velocity over a large portion of the operating range of the engine, the plug shape defining a diffuserless nozzle to locate the point of maximum flow velocity at the manifold edge of the plug for better atomization of the fuel and uniform distribution into the air stream for flow into the manifold, the plug having an annular fuel induction port opening into the zone and connected by conduit means to an induction-type fuel supply slot by an overlapping christmas tree-shaped slot, air also being variably supplied to the conduit means as a function of engine operation to vary the fuel induction signal and, therefore, the overall air/fuel ratio of the mixture flow to the engine.

7 Claims, 6 Drawing Figures

5A
5A
318
316
315
312
320
314
310
308
360
350
332
326
322
334
328
324
348
352
330
338
340
346
344
354
83
336
342
356
306
304
302
300
358
284
366
394
368
390
378
370
388
380
386
376
384
372
392
364
374
392
394
296
398
362
396
294
292
278
290
300

SONIC FLOW VARIABLE AREA VENTURI CARBURETOR

This invention relates, in general, to a motor vehicle type carburetor. More particulary, it relates to a carburetor of the variable area venturi type constructed and designed to provide better fuel atomization and a more homogeneous engine cylinder-to-cylinder mixture distribution than known carburetor constructions, to reduce emissions.

With today's emphasis on emission control, carburetor design is in a continual state of flux to provide constructions that will supply the engine with the correct air/fuel mixture at all times, so as to minimize the emission into the atmosphere of undesirable elements such as unburned hydrocarbons, carbon monoxides, etc. Most induction type carburetors cannot or do not provide a constant air/fuel ratio during steady state operation because of the variance of fuel flow signal with the air flowing at subsonic velocity through the carburetor induction passage. The flow will vary as a function of manifold vacuum changes and throttle position. Also, most known carburetors do not provide uniform fuel distribution to the engine cylinders because of the use of multiple fuel circuits for idle speed and main fuel flow, for example.

It is a primary object of the invention, therefore, to provide a carburetor construction that provides better fuel atomization and a more homogeneous distribution of fuel to each of the engine combustion chambers than known carburetor constructions, to permit engine operation at a leaner overall air/fuel ratio than normally is permitted, which results in a reduction of unburned hydrocarbons and carbon monoxides to less harmful forms, and a reduction in the formation of $NO_x$.

It is known that flow at or near sonic velocity, i.e., choked or critical flow, through a nozzle provides a constant flow rate independent of downstream pressure variations since the nozzle or opening is flowing the maximum.

It is another object of the invention, therefore, to provide a carburetor with an induction passage that contains a variable area venturi that operates in the critical or choked flow mode during at least a portion of the operating range of the engine to provide an essentially constant air/fuel mixture ratio to the engine at that time for maximum metering accuracy and better control of emission output.

It is a further object of the invention to provide a carburetor of the type described above that includes an air metering nozzle and a variable supply fuel meter that are so constructed and interconnected as to provide a change in one proportional to a change occurring to the other to maintain essentially a constant air/fuel mixture ratio.

It is another object of the invention to provide a carburetor of the type described above with an air/fuel mixture control operable in response to acceleration demand to change the essentially constant air/fuel ratio to one best for the desired operation.

It is another object of the invention to provide a carburetor of the type described above having a single fuel metering system operable over the entire operating range of the engine from idle speed to wide open throttle.

It is a still further object of the invention to provide a carburetor of the type described that includes a fuel induction system of a unique construction operably movable with the carburetor air metering control to maintain essentially a constant air/fuel ratio to the mixture upon changes in air flow.

It is another object of the invention to provide a carburetor of the type described above including fuel signal control means operable during cold engine conditions to vary the air/fuel mixture ratio to provide fuel enrichment during this time.

It is still another object of the invention to provide a carburetor in which the induction passage has a variable area venturi defined by a conically shaped air metering nozzle having a matching conical plug movably located centrally within the nozzle and so constructed and designed as to maintain sonic velocity to flow through the venturi during at least a portion of the engine manifold vacuum operating range, the venturi being defined by a converging flow section terminating in an elongated throat section or zone of constricted area, the throat section or zone being connected to a source of fuel past a fuel metering section that is movable with the plug to provide a change in effective fuel flow area that is proportional to the change in effective air flow area to maintain an essentially constant air/fuel ratio, an additional air-bias circuit being provided to spoil the fuel metering signal as a function of engine operating parameters to vary the air/fuel ratio according to the fuel richness or leaness desired.

Finally, it is an object of the invention to provide a carburetor of the construction described above that includes vacuum and mechanically actuated apparatus operably connected between the conventional vehicle accelerator pedal and the venturi plug to vary the position of the plug in response to depression of the accelerator pedal, in a manner to provide optimum fuel atomization and engine cylinder-to-cylinder fuel mixture distribution, and engine efficiency.

Other objects, features and advantages of the invention will become more apparent upon reference to the succeeding detailed description thereof, and to the drawings illustrating the preferred embodiment thereof; wherein, FIG. 1 is a cross-sectional view of a carburetor assembly embodying the invention;

Figure 1:
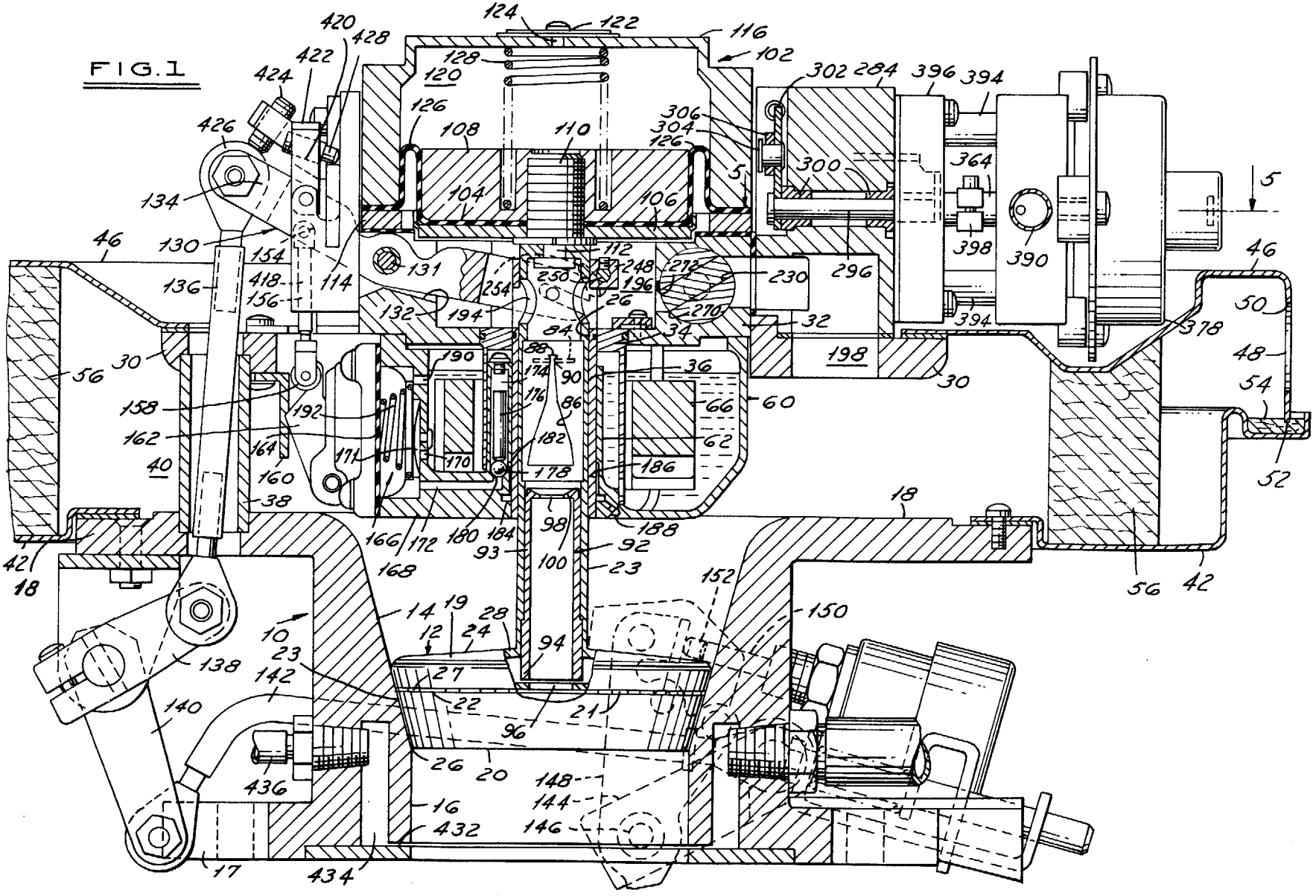

As shown in FIG. 1, the carburetor assembly is of the downdraft induction type. It includes the usual dry element type air cleaner 1 surrounding the inlet section 2 of the carburetor for supplying clean air to the same. The carburetor consists of a conically shaped air nozzle 10 in which is mounted a matching cone shaped pintle or plug 12 that can move to meter air flow through the nozzle and also supply fuel through the plug to the induction passage for combination with the metered air flow into the engine intake manifold.

The air nozzle 10 is defined, for example by a 15° half angle entrance cone 14 followed by a 2 ½ inch diameter cylindrical portion 16, having annular mounting flanges 17 and 18 at opposite ends. The lower flange 17 is adapted to be mounted over and connected to the intake manifold of an internal combustion engine. Portion 14 defines an air inlet that converges towards the manifold.

The pintle or plug 12 is a matching cone that can bottom in the nozzle cone 14 to shut off air flow. The plug is made in two pieces 19 and 20 that are bolted together with an annular spacer element 21 between. The spacer defines an annular metering slot or clearance 22 through which fuel may be inducted into a high velocity zone or constricted area 23 that is formed between the plug and nozzle when the plug is opened, as will be explained later. The plug is in the shape of an inverted truncated cone having a conical surface that mates with the conical surface of the nozzle to define a diffuserless nozzle. The like tapers of the plug and nozzle permit easy initial alignment of the plug in the nozzle, a simplicity to the construction, and an elimination of the need for air seals. Once the plug is closed, all air flow is shut off.

With no effective diffuser to the nozzle, the flow characteristics through the zone 23 between the nozzle and plug, therefore, is similar to that of a simple orifice; that is, the flow is at sonic velocity so long as the pressure in the intake manifold remains less than 0.528 of the air inlet pressure at the inlet to the nozzle, which is assumed to be atmospheric, and the throat or zone velocity slowly decreases below sonic as the manifold pressure increases above 0.528 atmospheric. The point of highest or maximum velocity, however, of the primary air flow will always be at the bottom edge 26 of the conical plug because of the sudden expansion down stream thereof, regardless of whether the nozzle is choked, i.e., at sonic velocity, or not.

The diffuserless plug construction provides a number of advantages. One, is simplicity of construction. The equal tapers of the plug and nozzle walls makes for easier manufacture since straight tapers are easier to build than conventional ones. It also provides an easier alignment of the plug in the nozzle since the plug can merely be dropped into the nozzle to shut off all flow and when the plug is open, the flow will be uniformly distributed all around the annular channel. Another advantage is that the discharge of fuel into the area of highest velocity immediately tears apart the fuel globules to atomize the fuel, and uniformly distributes the fuel into the air stream for better engine cylinder-to-cylinder distribution. Also, the sudden abrupt area change as the air/fuel mixture leaves the lower edge of the plug not only additionally helps to uniformly distribute the fuel in the air, but any fuel blown back against the plug is stripped off by the high velocity primary air at the lower edge of the plug. This action eliminates the formation of fuel drops and therefore increases the quality of the mixture of fuel in the air below the plug by providing a finer fog of fuel in the air.

The plug 12 includes a centrally located hollow stem portion, or tube 24 that projects axially upwardly from plug 12 and is fixed to it by an annular flange 28. Tube 24 is hollow as shown and in general is mounted for a vertically slidable movement within an upper mounting flange 30. More specifically, the mounting flange 30 is secured to an annular casting 32 within which is secured an annular cup-shaped cylinder 34 opening towards the bottom. Within the cylinder is fixed a sleeve 36 in which is slidably mounted the hollow stem portion 24 of plug 12.

The whole assembly just described is located vertically with respect to the air nozzle body portion 10 by means of four circumferentially spaced dowels 38. The dowels are seated between flanges 30 and 18, and fixed in place by a number of bolts, not shown. Spacing provided by the dowels defines an annular air passage 40 in the air cleaner assembly.

The air cleaner assembly includes a lower tray portion 42 secured to the nozzle mounting ring 18, and an upper annular cover 46. The cover is formed with a depending side wall portion 48 that has an air inlet aperture 50. The lower edge 52 of the side wall portion is embedded in an elastomeric annular seal 54 retained in a cross section formed on the lower tray. The two tray portions are axially spaced by an annular filter element 56 of the pleated paper type forcing all air to pass through the filter before entering into the carburetor induction passage.

As stated previously, one of the objects of the invention is to maintain as constant an air/fuel ratio to the mixture flow to the engine over as much of the engine operating range as is possible. The single fuel metering system to be described is constructed to cause a change in fuel flow that is proportional to changes in the air metering flow volume upon movement of plug 12. That is, the change in metering area divided by the plug stroke is a constant. This is accomplished by having a portion of the fuel metering element move with plug 12, and its particular geometric construction.

More specifically, the hollow stem portion 24 of plug 12 contains the fuel metering system. Secured to the bottom of casting 32 is a cup-like, donut-shaped fuel float bowl 60. The bowl has a radially inner wall 62 formed as a sleeve, and sealingly engages sleeve 36. As best seen in FIG. 3, casting 32 serves not only as a cover for the float bowl, but also has a support for the conventional fuel supply mechanism, which includes an annular float 66. The float is fixed on a lever 68 pivotally mounted at 70 to a hinge member 72 mounted to the casting 32. The float lever 68 supports an inlet valve 74, which in the uppermost position of the float, closes the end of a fuel passage 76 connected to fuel supply passage 78. Fuel normally is supplied under pressure to the passage 78 through an inlet 80 from a fuel pump assembly indicated in general at 82 in FIG. 2, in a known manner. A passage 83 permits venting of the fuel vapors out of the carburetor.

The float and fuel supply mechanism operate in a known manner. Lowering of the fuel level in the float bowl causes a clockwise pivotal movement of the float 66 to drop the valve 74 and permit flow of fuel through passage 76. Alternately, rise of the fuel to the level shown will raise the float to block off fuel flow through passage 76.

As best seen in FIG. 1, the stationary guide sleeve 36 surrounding the upper end of the tube 24 has a pair of diametrically opposed, narrow cross slots 84 that extend circumferentially as shown. Only one slot is shown, for clarity. Slots 84 are located above the level of the fuel in the float bowl, and constitute fuel induction ports. Coacting with the cross slots 84 are a pair (only one shown) of diametrically opposed, circumferentially and axially extending, tapered fuel metering slots 86 cut in the sides of the tube 24. The slots 86 are shown as diverging towards the manifold or in the direction of the plug 12, and have a somewhat Christmas tree shape. The slots 86 are shaped to provide a constant air/fuel ratio of, say, 15 to 1, for all positions of the plug except at wide open throttle, when it is shaped to richen the ratio. More specifically, the Christmas tree shaped slots 86 have an initial minimum flow area 88, which when aligned with the cross slot 84 provides the low fuel flow requirements necessary for engine idle speed operation. The remaining increasingly larger areas shown provide progressively greater fuel flow in scheduled proportion to the increase in air flow, by raising the plug 12, to maintain the air/fuel ratio constant. When the plug is in its downwardmost position shutting off air flow, the metering slots 86 will be below cross slots 84. The solid wall portion of sleeve 36 then will shut off all fuel flow.

To insure that the fuel flow will vary as a function of the change in the air metering flow volume, as stated before, the lower end of the tube 24 is mechanically locked to the air metering plug portion 19. Opening the air meter, therefore, opens up the connection of the fuel metering slots 86 to cross slots 84, and the matching of the air meter and fuel meter provides an air/fuel mixture ratio that will be constant over the major portion of the plug stroke range.

The lower end of tube 24 contains a fuel stripper device 92. It consists of a sleeve 93 fixed within tube 24 and open at its bottom 94 to a hole 96 connected to the fuel metering slot or space 22. At its upper end, sleeve 93 is formed with an orifice 98 and a bevelled or conical fuel inlet 100. Any liquid fuel droplets that may tend to collect on the walls of tube 24 if sleeve 93 were not present are stripped off by passage through the conical inlet 100, which directs the air/fuel mixture towards the axis of the tube 24 for entry into the metering slot 22.

Manifold vacuum always acts on the face of the lower plug portion 20 and, therefore, always attempts to shut the plug and close off air flow. To counteract this, the upper end of the tube 24 is provided with an oppositely directed vacuum compensating balance force. More specifically, the upper end of tube 24 is keyed to a force balancing vacuum servo 102. The servo includes an annular flexible diaphragm type piston member 104 that is secured between an annular retainer 106 and a nut 108. The nut is screwed onto a studlike connector 110, which is fixed to the metering tube 24 by a bayonet type connection 112. The edges of the diaphragm 104 are sealing secured between flanges of a ring 114 and a cover member 116 screwed to the float bowl mounting casting 32. A manifold vacuum connection 118 (FIG. 2) connects the chamber 120 inside cover 116 to a pressure tap, not shown, located in the induction passage below the plug 12. Any vacuum forces acting on plug 12, therefore, also act in chamber 120 to provide a pressure force balance to eliminate movement of the plug under the influence of these forces alone.

It will be clear, of course, that should a pressure unbalance be desired, the effective area of the balance servo 102 could be changed as a matter of choice to provide whatever forces are desired. A flat reed type valve 122 covering a vent 124 is provided to prevent rolling of the edges 126 of diaphragm 104 in a backward direction upon an inadvertent pressure reversal, such as during an engine backfire. A spring 128 normally biases the plug 12 to a closed position.

Plug 12 is moved to provide greater or less air and fuel flow volumes to satisfy all engine requirements while at the same time attempting to maintain the nozzle in as close to a critical flow mode as possible. This is desirable because operating in choked flow mode provides maximum metering accuracy. This is accomplished by connecting the plug 12 through mechanical linkage to the conventional driver actuated accelerator pedal.

More specifically, the upper end of metering tube 24 is connected to the yoke shaped end 129 (FIG. 2) of a lever 130 that is pivoted at 131 on casting 32. Lever 130 is flat on two sides and arcuately formed as seen in FIG. 1 to extend sealingly through a side opening 132 in casting 32. The opposite end 134 of lever 130 is pivotally connected by a vertical link 136 through spacers 38 to the end of an actuating lever 138. Lever 138 in turn is pivotally connected through other linkage 140 and 142 to a lever 144 fixed on the accelerator pedal moved "throttle" shaft 146. Also fixed on the shaft is a throttle positioning lever 148 adapted to be contacted by a solenoid operated throttle plunger 150. The solenoid would be connected electrically to the engine ignition circuit, not shown, so that when energized it will move the plunger to the dotted line position 152, or prevent return movement of lever 148 past the dotted line position, when moving in the opposite direction. This establishes a normal idle speed position of plug 12, as will be explained in more detail later. When de-energized, the plunger 150 retracts to the full line position, which is the anti-diesel position. In this position, the plug 12 fully closes and, therefore, shuts off all air and fuel flow.

Depression of the accelerator pedal, therefore, rotates throttle shaft 146 to pull end 134 of lever 130 downwardly. This pulls metering tube 24 and plug 12 upwardly to open the air meter and not only increase the area of zone 23 but also the fuel metering area of slot 86 with respect to slot 84, for a greater induction of fuel.

The lefthand portion 134 of lever 130, as seen in FIG. 1, pivotally mounts the upper end 154 of a link 156 forming part of a float bowl contained conventional operator controlled accelerator pump assembly. The lower end of link 156 mounts a roller 158 that moves along a reaction member 160, upon movement of lever 130, against a cam follower 162. The cam follower is fixed to a flexible diaphragm 164 covering a fuel chamber 166. The chamber is formed as part of an accelerator pump housing 168 mounted in float bowl 60. A fuel inlet port 170 connects chamber 166 with the fuel and float bowl 60, past an umbrella type one-way check valve 171. An outlet passage 172 connects to a well 174 that interrupts a portion of the annulus between the float bowl inner wall 62 and sleeve 36. The well 174 is capped as shown and slidably contains a weight 176 urging a ball valve 178 against a seat 180 to close a discharge passage 172. An outlet port 182 connects with an annulus 184 by means of a relief portion 186 in wall 62 of the float bowl 60. The annulus communicates the fuel to a number of circumferentially spaced shooters or nozzles 188 angled as shown to inject a slug of fuel into the main or primary air inlet passage 40. Accelerator pump chamber 166 is vented at 190 to the space above the fuel level. A spring 192 normally biases the can follower 162 to the inoperative position shown in FIG. 1.

It will be clear that depression of the accelerator pedal will move the cam follower 162 to push diaphragm 164 to discharge fuel from the filled chamber 166 past the ball valve 178 into the air stream, release of the pedal permitting the spring 192 to return the diaphragm 164 to the inoperative position, the resulting suction opening check valve 171 and again filling chamber 166 with fuel.

As described, the main fuel metering system defined by the metering slots 86 maintains an essentially constant air/fuel ratio at all operating stages except at wide open throttle. Since the air/fuel ratio should change according to engine requirements, to provide cold enrichment, etc., for example, some means must be provided to vary the air/fuel ratio when desired. This is accomplished by a secondary air bias circuit that in effect spoils or changes the vacuum signal acting through the fuel metering slot 86 on the exposed part of cross slot 84 to change the pressure differential across the slots. More specifically, the upper end of metering tube 24 has a number of large holes 194 that connect the tube to a secondary air chamber 196 formed in casting 32. Chamber 196 receives a supply of air from the primary air supply passage 40 through an opening 198 in flange 30, which opening flows air past a number of control devices.

Figure 2:
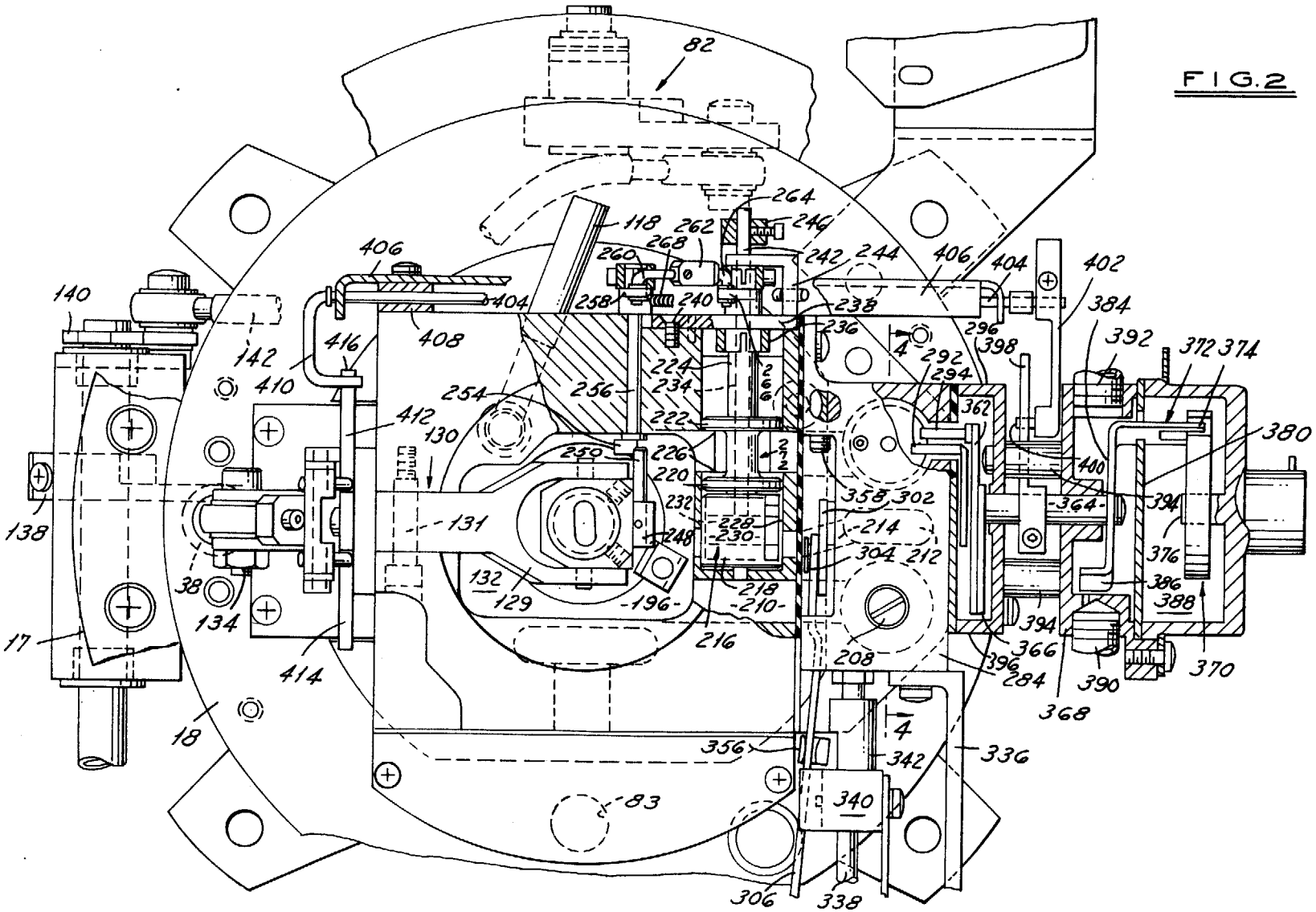
FIGS. 2 and 3 are top plan and end elevational views, respectively, of the carburetor assembly shown in FIG. 1.
Figure 3:
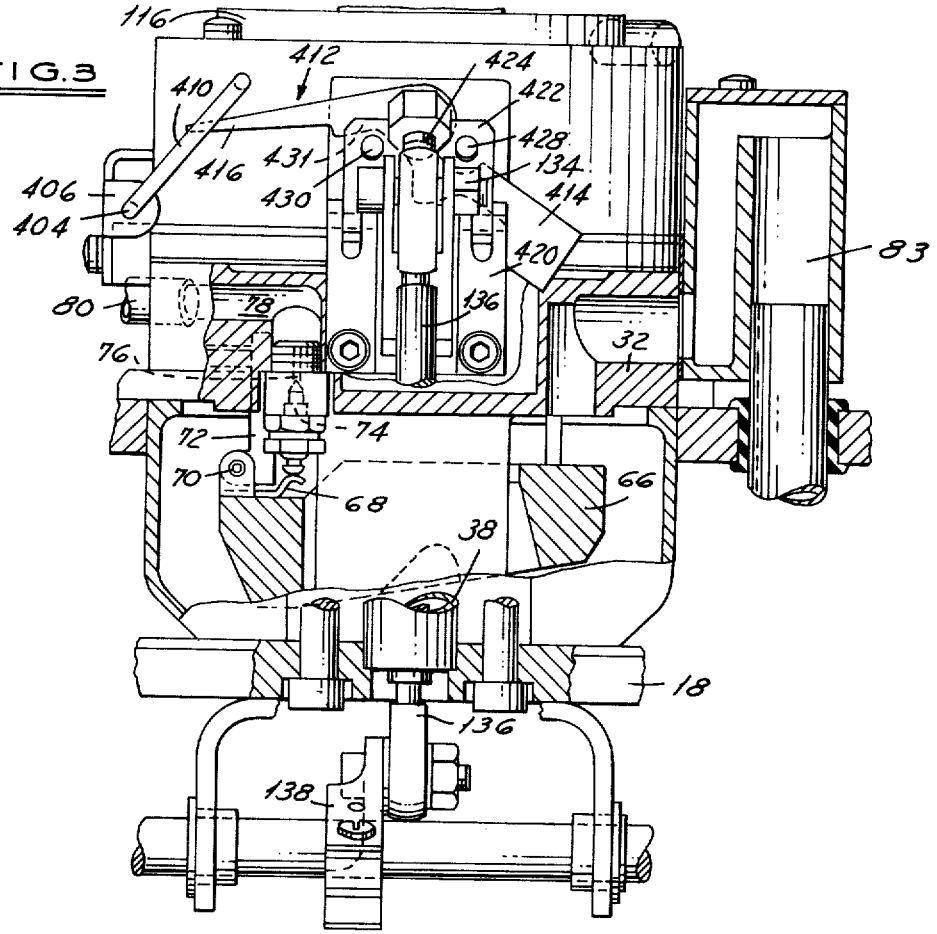
Figure 4:
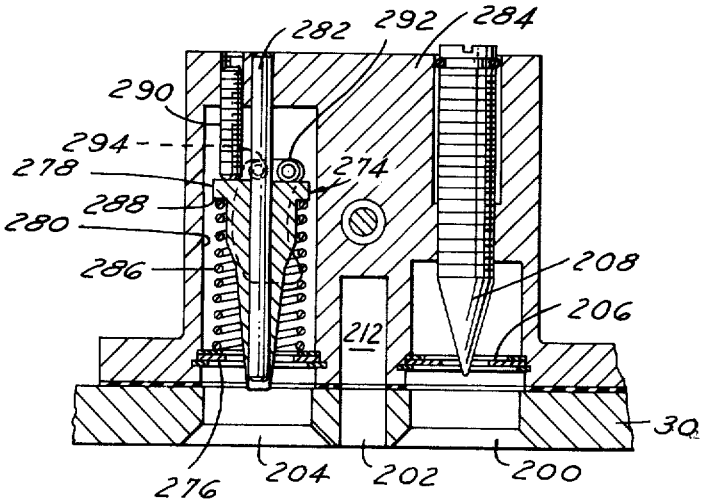
FIG. 4 is a cross-sectional view taken on a plane indicated by and viewed in the direction of the arrows 4—4 of FIG. 2.

As best seen in FIGS. 1, 2 and 4, air flow through the opening 198 in flange 30 can pass upwardly through three openings 200, 202, and 204. Opening 200 contains an orifice or flow restricter 206 that cooperates with an adjustably mounted needle valve 208. The valve is preset to define the flow area through the orifice to allow a constant controlled volume of air into a passage 210 (FIG. 2) connected to chamber 196. The central chamber 202 (FIG. 4) flows the air into an oval shaped (FIG. 2) channel 212 that is connected to secondary air chamber 196 by a conduit 214 past a barrel valve assembly 216.

The barrel valve assembly 216 includes an axially extending barrel valve 218 and a pair of equal diameter, spool like bearing lands 220 and 222, all interconnected by sleeve portions 224 of reduced diameter. The two bearing lands 220 and 222 axially locate and rotatably mount the barrel valve between a pair of shoulders 226 projecting inwardly from the valve body.

The barrel valve 218 contains a slot 230 (FIGS. 1 and 2) that extends axially the length of the valve. The slot connects and controls air flow through conduit 214 to air chamber 196. Axially slidably received within slot 230 is a plunger or piston 232 that is secured to a rod or stem 234. The stem is slidably mounted in a bore within sleeve portion 224. The end sleeve portion 224 projects through a clamp 236 on a square locating plate 238. The plate is secured to the carburetor body by screws 240 to axially locate the plunger 232 to control total flow volume through slot 230 by widening or narrowing the cross slot.

End 242 of rod 234 is slidably and rotatably guided in a support bracket 244 fixed to the carburetor body. A stop plug 246 is adjustably keyed to the rod and limits the axially movement of plunger 232. It will be clear that the axial position of the plunger 232 will determine the amount of secondary air that can flow from conduit 214 to chamber 196, i.e., the flow capacity, and that the rotary position of the barrel valve (and slot 230), as seen in FIG. 1, will determine when it can flow. The total flow through slot 230 is used as a control of the air/fuel ratio for normal engine idle speed operation, and channel 212 thus could be termed an idling channel.

The axial position of the plunger 232 would be preset at the factory to suit the particular capacity requirements at idle. The rotary position of barrel valve 232, however, will vary as a function of the vertical position of plug 12, and therefore, operation of the engine. More specifically, as stated previously, the accelerator pedal linkage solenoid armature 150 in FIG. 1 determines the idle speed position of plug 12 during engine operation at normal or warmed up temperature levels. That is, when the accelerator pedal is released, the plug lever 148 comes to rest against plunger 150, which then through linkage 144, 142, 140, 138, 136 and 130 locates the vertical position of metering tube 24.

The fuel metering system basically provides a rich air/fuel ratio. Therefore, the idle channel 214 is used to flow additional air to tube 24 to lean out the mixture air/fuel ratio to the idle speed level desired. This is accomplished by translating vertical movement of the metering tube 24 into a rotary movement of barrel valve 218 and slot 230. In this case, a block 248 (FIG. 1) secured to the upper outer portion of tube 24 carries an actuating cam or pin 250. As seen in FIGS. 1 and 2, the opposite end of pin 250 engages the cam follower surface of an eccentric 254. Eccentric 254 projects off center from a shaft 256 rotatably mounted in the carburetor. Shaft 256 projects outwardly of the carburetor and carries an eccentric 258 in which is rotatably inserted one end of a link 260. The opposite end of link 260 is inserted in one end of a hollow adjustment coupler 262 that mounts the end of a second link 264. The second link is pivotally inserted in an ear 266 that projects from a clamp on the end of the barrel valve sleeve portion 224. The coupler 262 permits a longitudinal adjustment between the ends of links 260 and 264 to vary the rotative position of eccentric 258 with respect to ear 266 to change the idle speed mixture ratio. A tension spring 268, connected at one end to a portion of the carburetor, is connected at its other end to eccentric 258 to bias the barrel valve sleeve portion 244 in a clockwise direction (FIG. 1) toward a barrel valve closed position, which is attained when the edge 270 of slot 230 is moved to the point 272 on the valve body.

To establish the idle speed air flow through channel 214, therefore, first the eccentric 254 would be rotated against the idle speed position of pin 250. Then one of the ends of either link 260 or 264 would be adjusted in coupler 262 to rotate the barrel valve 218 to its zero position, which would be whatever position is precalculated for the air flow requirements. This then would provide the quantity of secondary air desired to establish the idle mixture air/fuel ratio.

As thus far described, therefore, secondary air can flow into the air cleaner from the primary channel 40 through the metered opening 206 past the needle valve 208, or through the idle speed channel 212 and the controlled slot 230.

The air chamber 196 also receives secondary air through a third passage 272 (FIG. 2) that connects the air chamber to the primary air opening to the primary air opening 204 (FIG. 4) through the space between barrel valve lands 220 and 222. The air flow is controlled by a needle valve assembly 274 to provide enrichment of the air/fuel ratio when power conditions are called for, or when the engine is operating below the normal operating temperature level. The assembly includes an annular orifice plate 276 cooperating with a needle valve 278 to control flow of air from opening 204 to a cylindrical chamber 280. The needle valve 278 is slidably mounted on a pin 282 that is pressed into a housing 284. A spring 286 seated between the orifice plate and a flange 288 on the needle valve, biases the needle valve against a stop 290. The stop is adjustably mounted, as shown. The valve 278 can move from the maximum flow position shown to a position seating in the orifice plate 276 to cut off all flow.

The valve 278 is moved between its two extreme positions by two independent pin actuators 292 and 294. As seen best in FIGS. 5 and 5*a*, pin actuator 292 is fixed on the end of a link 296 that is fixed on a shaft 298. The shaft is rotatably mounted in sleeve bearings 300 to project through housing 284 for pivotal connection to one end of a second link 302. The link 302 is pivotally connected by a rivet 304 to a thin flexible or springable link 306. Link 306 is connected by a spring 308 to a clamp 310 fixed on a vacuum tube 312.

Tube 312 is adapted to be connected to the engine intake manifold at any convenient spot, not shown, and projects from the hollow housing 314 of a vacuum motor unit 315. The latter is closed at one end by a nut 316 that adjustably mounts a guide rod 318. The guide rod is fixed to a seat 320 for a spring 322. The opposite end of the spring seats in a cup-shaped retainer 324 fixed to an annular flexible diaphragm 326, a second retainer 328, and an L-shaped actuator 330. The diaphragm 326 is edge mounted between the housing 314 and a cover 332 to define with housing 314 a vacuum chamber 334, the opposite side of the diaphragm being exposed to atmospheric or ambient pressure.

Cover 332 is mounted on an L-shaped bracket 336 that is bolted to boss 284. Also supported on boss 284 is a shouldered bolt 338 that helps support the vacuum motor housing, but more importantly, serves as a slide rail for a guide 340. The guide is secured to the L-shaped actuator 330 by set screws, and is normally positioned by the servo spring 322 to the one position shown against a collar 342. The guide 340 is moved by the vacuum motor along the slide rail 338, and contains a button 346 that is adapted to engage in a hole 348 in flexible link 306 when the two are aligned and the link 306 is flexed inwardly to a point where it can be engaged.

More specifically, mounted outside the carburetor adjacent the fuel bowl vent line 83 is a solenoid 350 having a rod type armature 352 that retracts to the position shown when de-energized. When energized, the rod moves outwardly to engage and move the end of a finger-like flexible actuating member 354. The latter is cantilever mounted on boss 284 and has a yoke type connection 356 to link 306. Movement of rod 352 then pushes member 354 and link 306 in the same direction to press link 306 against button 346. If the vacuum motor 315 moves guide 340 to the right, the button 346 will then engage in the hole 348 of link 306 and the vacuum motor and guide will be locked together. Subsequent movement of the vacuum motor in either direction then will cause the link 306 to pivot link 302 between the full and dotted line positions shown in FIG. 5a or against a stop 358. This will simultaneously arcuately move actuating pin 292 in FIG. 5 in the same direction to vary the vertical position of needle valve 278 (FIG. 4). The flow area between the orifice plate 276 and needle valve will, therefore, be proportionally varied.

Figure 5:
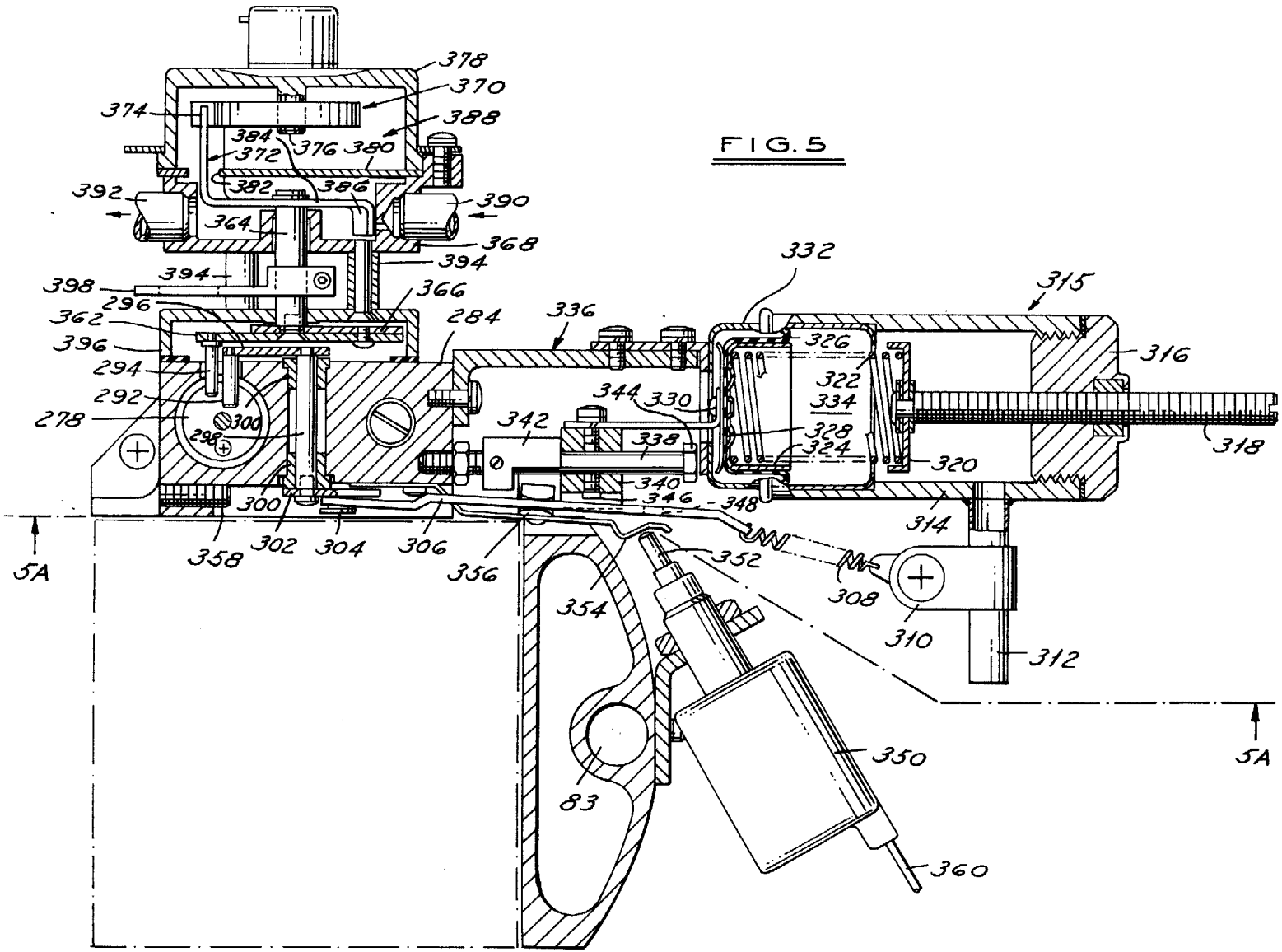
FIG. 5 is a cross-sectional view taken on a plane indicated by and viewed in the direction of the arrows 5—5 of FIG. 1.

The solenoid 350 in FIG. 5 is connected by an electrical harness 360 to the vehicle ignition circuit, not shown, so that it is energized when the ignition switch is turned to an on or run position, but not a start position, and remains energized until the ignition switch is again turned to the off position. Therefore, so long as the engine is running, whenever the manifold vacuum in tube 312 drops below the force of vacuum motor spring 322, the spring will push the guide 340 and link 306 leftwardly in FIG. 5a to rotate shaft 296 counterclockwise. This will move pin 292 and needle valve 278 in FIG. 4 downwardly to choke off the secondary air flow through chamber 280. This will cause the fuel metering cross slot 84 in FIG. 1 to be subject to a higher vacuum signal, resulting in a richer air/fuel ratio of the mixture flowing down through the tube 24. The lower the needle valve 278 drops, therefore, the richer the air/fuel ratio will become.

As stated previously, the movement of needle valve 278 is also controlled by the pin 294 to provide air/fuel ratio enrichment during cold engine operation. More specifically, as best seen in FIGS. 1, 2 and 5, the pin 294 is secured to the end of a lever 362 that is fixed to the end of a shaft 364. A weight balance member 366 is fixed to lever 362 as shown to permit it to remain in any position attained. The shaft 364 projects through the wall of a housing 368 containing a temperature responsive, bi-metallic, coiled spring element 370 that is sensitive to temperature changes to influence the position of the pin 294 and thereby influence the air/fuel ratio. More specifically, an L-shaped lever 372 is secured on the end of shaft 364 with one leg portion 374 engaged with the outer end of the coiled spring 370. The inner end of the spring is mounted on a stub shaft 376 projecting from a heat insulating type cover 378. The cover is secured to housing 368 as shown with an annular gasket 380 between, the gasket having an arcuate slot 382 permitting movement of the lever 372.

The other leg portion 384 of lever 372 has a small circumferential portion 386 that serves as a flow blockage member to partially block the flow of hot air into the chamber 388 defined within the housing and cover. The hot air originates in a tube 390 adapted to be connected to a suitable exhaust manifold heat stove, for example, in which air is drawn past the manifold to absorb the heat and pass into the tube 390. The opposite side of the housing 368 contains another tube 392 that is adapted to be connected to a portion of the carburetor induction passage below the plug 12 so as to always be subject to manifold vacuum. This creates the pressure differential necessary to draw the hot air into the chamber 388 from tube 390 to warm the bi-metallic spring 370 and thereby cause a rotation of shaft 364 to cause a similar movement of the actuating pin 294 to change the air/fuel ratio. Blockage member 386 permits only a small trickle of hot air flow into chamber 388 until it rotates to a position completely uncovering the tube 390. The warming of coiled spring 370 rotates lever 384, shaft 364, and blockage member 386. Once member 386 fully uncovers tube 390, the increased the flow of hot air causes a faster warming of the coiled spring 370 and, therefore, a faster leaning of the richened air/fuel ratio.

In addition to controlling the air/fuel ratio during cold engine operation, the thermostatic coiled spring element 370 also controls the fast idle position of plug 12 to provide that extra volume of air/fuel mixture desired during cold engine operation to overcome the increased engine friction, etc. More specifically, as best seen in FIG. 2, a number of circumferentially spaced supports and spacers 394 separate the thermostatic coiled spring housing 368 from a housing 396 enclosing the pin actuating members and levers. The spacing permits the clamping of a finger actuating member 398 to shaft 364, the finger member at times bearing against the pin end 400 of a lever 402 secured on an elongated actuating shaft 404. Shaft 404 extends rotatably through a U-shaped support member 406 fixed to the carburetor body as shown at 408.

Referring now to both FIGS. 2 and 3, the lefthand end, as seen in FIG. 2, of shaft 404, has a reverse bend portion 410 to overlie the end of the fast idle cam 412. The fast idle cam is rotatably supported on a shoulder bolt, not shown, projecting from the carburetor body, and has a weighted portion 414 that normally urges the fast idle cam 412 to fall by gravity in a clockwise direction so that the finger portion 416 of the cam will normally be in engagement with the underside of the reverse bend portion 410 of shaft 404.

As best seen in FIG. 1, a boss 418 projects from the carburetor casting 34. The upper lefthand portion of boss 418 is formed as a pair of yokes or clevises 420 in which is pivotally mounted a U-shaped stop support 422. The latter fixedly mounts an adjustable stop member 424 that as shown in FIG. 1 is adapted to bear against the upper end 426 of link 136 to limit the closing movement of plug 12, as will be described more in detail later. The stop support 422 also supports a pair of adjustably mounted stops 428 and 430 that are adapted to cooperate with the stepped face surface 431 of fast idle cam 412 in a manner to provide the conventional fast idle cam operation. That is, as seen in FIG. 3, the side of fast idle cam 412 is contoured to slip under and engage the stop screw 430 at times to prevent the clockwise pivotal movement as seen in FIG. 1 of the stop screw and thereby prevent closing of the plug to its normal engine idle speed position, when the engine operating temperature so dictates. Alternately, the stop screw 428 will engage the top surface portion of fast idle cam 412 at other times to also locate the fast idle speed position of the plug where desired according to the prevailing temperature level.

In brief, when the engine operating temperature drops below the normal design level, the thermostatic spring 370, as shown in FIG. 2, will contract to rotate the lever 372 and shaft 364 to thereby rotate shaft 404. As seen in FIG. 3, clockwise rotation of the end 410 of shaft 404 will urge the fast idle cam 412 downwardly. Then, upon the operator depressing the accelerator pedal to move down the plug 12, linkage including link 136 pivots support 422 counterclockwise so that cam 412 will be free to fall by gravity in a clockwise direction (FIG. 3) against bend 410 and thereby allow the fast idle cam 412 to assume the position dictated by the shaft 404 and coil spring 370. Release of the accelerator pedal then will raise the link 136 against the fast idle stop 424 until one or the other of the stops 428 or 430 engages the adjacent surface of the fast idle cam 412 and thereby prevents further pivotal movement of the stop 424. This then will fix the fast idle position of link 136 and plug 12 in proportion to the change in temperature level of the coiled thermostatic spring 370 from the normal engine operating temperature level.

Before proceeding to the overall operation, it should be noted that the bottom portion of the air nozzle is provided with an annular induction port 432 (FIG. 1) connected to an annulus 434. The annulus in turn may be connected through a tube 436 to any one of a number of exhaust emission control devices, such as, for example, a positive crankcase ventilation inlet tube or an exhaust gas recirculation tube, for the induction of unburned hydrocarbons, etc., back into the engine for the control of emissions.

Figure 5A:
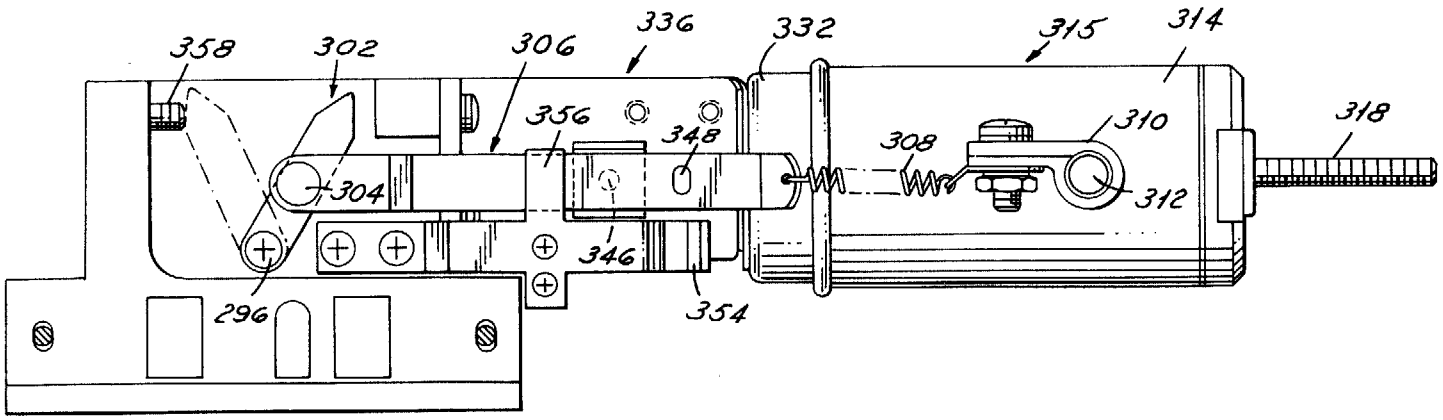
FIG. 5*a* is a cross-sectional view taken on a plane indicated by and viewed in the direction of the arrows 5*a*—5*a* of FIG. 5.

In operation, assume that the engine is off. The armature 150 of the starter solenoid in FIG. 1 will be retracted permitting the force balance servo spring 128 and linkage 136 to fully close the plug 12. Solenoid 350 in FIG. 5 is not energized; therefore, the armature 352 is retracted permitting the spring 308 to pull the link 306 out of contact with the button 346 on the guide 340. The spring 308 also pulls the link 306 to the right as seen in FIGS. 5 and 5a to rotate the shaft 296 clockwise and raise the pin actuator 292 to permit the needle valve 278 to assume its upper extreme position shown in FIG. 4. This provides full air flow and no enrichment during cranking in this particular secondary air circuit. The power valve solenoid 350 in FIG. 5 is energized only when the ignition switch is turned to the on position rather than the start or crank position.

During cranking, the vacuum signal force generated by the engine acting on the primary air circuit and the fuel metering air biasing circuit is low compared to when the engine is operating normally. For example, the cranking vacuum may be at only a 1 inch Hg. level. Accordingly, flow through the narrow zone 23 will be at a subsonic level with the weak vacuum signal providing a proportion of air and fuel to the engine that is richer than during normal engine idle operation at higher or sonic velocity levels. The cranking mixture might be at a 14 to 1 air/fuel ratio, for example, as compared to a 15 to 1 ratio at idle speed operation. This compares to a conventional carburetor cranking air/fuel ratio of 10 to 1, for example.

Assume then that the engine has been cranked and started under normal engine operating temperature levels, or when the engine is warmed up or the ambient temperature conditions are high. Immediately, the now high manifold vacuum level acting on the narrow zone 23 causes the primary air to flow through the area between the plug and nozzle at sonic velocity. This generates a constant high vacuum signal in slot 22 and in the fuel metering slot 86 to induct fuel from the slot 84 into slot 86 while at the same time drawing secondary air into tube 23 from air chamber 196. The air mixing with the fuel emulsifies the fuel and the flow at sonic velocity into the primary air stream finely atomizes the fuel particles for a homogeneous distribution into the air for flow into the engine cylinders. At idle, the idle block 248 on tube 24 is in the position shown in FIG. 1 camming the eccentric 254 to a position where the spring 268 (FIG. 2) has rotated the barrel valve 218 and slot 230 to, say, the angled position shown in FIG. 1. Thus, secondary air flows into the air chamber 196 through slot 230 in addition to the air flowing constantly through passage 210. This will lean the idle mixture air/fuel ratio to the desired value of approximately 15 to 1.

If the engine had been started under cold engine conditions, then it would have been necessary to richen the air/fuel ratio during idle as well as provide greater air flow to sustain engine operation under increased friction conditions, etc. This would be accomplished by the thermostatic coiled spring 370 rotating the actuating pin 294 to push down needle valve 278 and progressively close off air flow through the passage 272 to chamber 196. For the same vacuum signal generated in the metering slot 22, therefore, the decrease in secondary air flow provides a greater pressure differential across the fuel metering slot 84 to draw in more fuel at this time, which richens the mixture.

At the same time, rotation of the thermostatic spring 370 rotates shaft 404 to position the fast idle cam 412 for a higher idle speed. That is, upon depression of the vehicle accelerator pedal linkage, the link 136 will be moved downwardly in FIG. 1 allowing the fast idle cam 424 to be moved to the fast idle position by the reverse bend portion 410 shown in FIG. 3. This will position the face 431 or high step of the fast idle cam under the stop 430 so that when the accelerator pedal is released, the stop will come to rest against the high step. As seen in FIG. 1, this will pivot the support member 422 to the left and prevent the link 136 from attaining the position shown. The plug 12, therefore, will be opened more or to a higher position allowing more primary air and air/fuel mixture past the plug, with more of the metering slot 86 being exposed to slot 84. The position of the plug and the fast idle cam, of course, will vary in proportion to the degree or change of temperature from the normal operating level. The colder it is, the more the plug will be raised and the more the needle valve 278 will be closed to further richen the air/fuel ratio.

Assume now that acceleration is called for by depression of the accelerator pedal beyond the engine idle speed position. Smooth acceleration requires a momentary increase in supply of fuel. The air flow through the carburetor responds almost immediately to any increase in plug opening. However, the fuel within the metering passages 84 and 86 will lag momentarily in its response to the pressure difference created by this increased air flow. This lag in fuel response can cause a temporary leanness in the fuel-air mixture that results in a hesitation in engine acceleration. The mechanically operated accelerating pump system, therefore, supplies the added single shot of fuel to provide a richer fuel-air mixture for the brief of time until the power valve system shown in FIG. 5 can take over. In this case, depression of the accelerator pedal lowers the link 136, as seen in FIG. 1, and simultaneously moves down the accelerator pump actuator roller 158. This cams the member 162 right-wardly to move the diaphragm 164 in the same direction and therefore pump fuel past the ball valve 178 out through the shooters 188 into the primary air circuit.

With respect to the power valve operation, until the ignition switch is turned to the on position, the power valve parts will remain in the positions shown in FIG. 5; that is, inoperative. However, when the ignition switch is turned to the on position, the solenoid 350 becomes energized and pushes the armature 352 outwardly. This moves the actuator 354 and link 306 outwardly so that the hole 348 is in the path of movement of the button 346. Then, when engine running vacuum is applied through tube 312 to the vacuum servo, it will pull the diaphragm 326 to the right moving the guide 340 with it until the button 346 pops into the hole 348 to lock the vacuum servo to the link 306. Thereafter, whenever the manifold vacuum decays below a predetermined level enough to permit the spring 322 to begin moving the guide 340 leftwardly, then the lever 306 will be moved progressively in the same direction to pivot the lever 302 (FIG. 5*a*) and rotate shaft 296 counterclockwise. This will move actuating pin 292 to cam the needle valve 278 downwardly to choke off the secondary air flow through this channel and accordingly enrichen the air/fuel ratio. Of course, as the manifold vacuum begins to increase or the vehicle accelerator pedal is slowly released, then the vacuum servo of the power valve will begin rotating the shaft 296 in the opposite direction permitting the needle valve 278 to again rise and permit more secondary air flow through the metering tube 23. The air/fuel ratio mixture will then return to its essentially constant level of approximately 15 to 1.

During acceleration, of course, the raising of plug 12 also raises the fuel metering slot 86 so that a wider fuel metering area is aligned with the cross slot 84 to permit a greater volume of fuel flow out through the fuel metering slot 22. At wide open throttle conditions, the width of the fuel metering slot 86 is approximately the same as the capacity of the cross slot 84 to flow the maximum volume of fuel at this time.

It should also be noted that as soon as the vehicle accelerator pedal is depressed towards an off idle position, the raising of the plug 12 and tube 24 raises the cam or pin 250 and permits the eccentric 254 to rotate clockwise (FIG. 1) which results in a clockwise rotation of the barrel valve 218 to a closed position. The leaning out of the mixture for idle, therefore, is eliminated as soon as the off idle conditions are attained since the closing or near closing of the barrel valve to its zero position shuts off or minimizes any secondary air flow through the idling channel 214.

When the engine is shut down, opening of the ignition switch deenergizes the solenoid in FIG. 1 to cause a retraction of armature 150 to the solid line position. This permits the linkage 148, 144, 142, 140, 138, 136 and lever 130 to fully close the plug 12 and shut off all air and fuel flow to prevent engine dieseling.

While the invention has been shown and described in it preferred embodiment, it will be clear to those skilled in the arts to which it pertains that many changes and modifications may be made thereto without departing from the scope of the invention.

We claim:

1. A carburetor having an air/fuel induction passage open at one end to a source of air essentially at atmospheric pressure and connected at its other end to the intake manifold of an internal combustion engine to be subject at all times to the vacuum signal therein to effect air flow thereinto, a variable area venturi in the passage defined by an air nozzle receiving a movable plug therein, the air nozzle including a conical air inlet portion, the plug being an inverted truncated cone defining with the nozzle conical portion a diffuserless nozzle locating the point of highest velocity of fluid flow at the engine manifold edge of the plug, the plug having a conical surface mating with the nozzle conical portion, the plug being axially movably mounted within the nozzle to define a variable area constricted flow zone between the nozzle and plug and being so constructed and arranged as to flow air therethrough at sonic velocity over most of the operating range of the engine to provide an essentially constant fuel metering signal and atomization of fuel flowing thereinto to provide accurate air/fuel ratio control of the mixture flow to the engine, the plug being movable between a first position essentially closing the passage and zone and other positions variably opening the passage and zone, a hollow stem portion fixed to and projecting axially upwardly from the plug, means connecting air to the upper end of the stem portion, conduit means connecting the lower end of the stem portion through the plug to the high velocity constricted zone in the induction passage to induce an air flow from the stem portion into the induction passage in response to the vacuum signal generated at the zone upon flow of air through the venturi to the engine intake manifold upon operation of the engine, a stationary fuel float bowl containing fuel and slidably and sealingly receiving the stem portion therethrough for maintaining axial alignment of the plug in the nozzle upon vertical movement of the plug, the stem portion wall having an axially long circumferential siphon type fuel metering induction slot therethrough of essentially christmas-tree shape diverging axially towards the manifold providing the total metered fuel flow requirements of the engine from engine cranking to wide open throttle operations, the float bowl having an axially narrow circumferential fuel discharge port located above the level of the fuel and contiguous with the stem portion wall and in the path of movement of the fuel induction slot so as to align with it at times, whereby upward movement of the plug to increase nozzle air flow volumes progressively communicates larger areas of the stem portion induction slot with the fuel bowl discharge port to meter the induction of progressively larger volumes of fuel along with the air into the conduit means and therefrom into the high velocity zone area for atomization of the fuel, operator controlled means connected to the plug to effect vertical movement of the plug, and adjustable valve means to vary the air flow supply to the upper end of the stem portion to control the level of the vacuum induction signal acting on the fuel in the slot and port to thereby control fuel flow and the overall air/flow ratio of the total mixture passing into the intake manifold.

2. A carburetor as in claim 1, the float bowl fuel discharge port extending circumferentially to a width essentially the same as the width of the widest circumferential portion of the fuel induction slot, and having a narrow axial extent equal essentially to the width of the narrowest circumferential portion of the induction slot.

3. A carburetor as in claim 1, the air supply to the interior of the stem portion including secondary conduit means diverting a portion of the main flow of air to the stem portion interior past the fuel induction port, the adjustable means comprising tapered valve means movably mounted in the secondary conduit means and movable between positions providing minimum and maximum flow of secondary air through the secondary conduit means.

4. A carburetor as in claim 1, including movable temperature sensitive means connected to and moving the adjustable valve means to vary the air flow volume in the conduit means and thereby the overall air/fuel ratio as a function of temperature changes from a predetermined level.

5. A carburetor as in claim 4, the temperature sensitive means comprising a bi-metallic spring coil having an end circumferentially expandable and contractible with temperature changes for movement of the adjustable means.

6. A carburetor as in claim 1, including linkage means connecting the operator controlled means and the adjustable valve means for manually moving the adjustable means in response to acceleration or deceleration demands to adjust the secondary air flow and thereby vary the air/fuel ratio of the mixture flowing into the intake manifold.

7. A carburetor as in claim 1, including a manifold vacuum controlled servo connected to the plug stem portion for balancing the vacuum forces acting on the manifold side of the plug.

* * * * *